US010989363B2

(12) United States Patent
Yang et al.

(10) Patent No.: US 10,989,363 B2
(45) **Date of Patent: *Apr. 27, 2021**

(54) LED FILAMENT AND LED BULB WITH LED FILAMENT

(71) Applicants: KAISTAR Lighting (Xiamen) Co., Ltd., Xiamen (CN); EPISTAR CORPORATION, Hsinchu (TW)

(72) Inventors: Chien-Li Yang, Xiamen (CN); Yu-Chun Chung, Xiamen (CN); Yu Min Li, Xiamen (CN)

(73) Assignees: KAISTAR LIGHTING (XIAMEN) CO., LTD., Xiamen (CN); EPISTAR CORPORATION, Hsinchu (TW)

( * ) Notice: Subject to any disclaimer, the term of this patent is extended or adjusted under 35 U.S.C. 154(b) by 75 days.

This patent is subject to a terminal disclaimer.

(21) Appl. No.: 16/241,818

(22) Filed: Jan. 7, 2019

(65) Prior Publication Data

US 2019/0137048 A1 May 9, 2019

Related U.S. Application Data

(63) Continuation of application No. 15/191,660, filed on Jun. 24, 2016, now Pat. No. 10,215,342.

(30) Foreign Application Priority Data

Jul. 17, 2015 (CN) ..... 201510423074.0

(51) Int. Cl.
*F21K 9/232* (2016.01)

(52) U.S. Cl.
CPC ..... *F21K 9/232* (2016.08)

(58) Field of Classification Search
CPC .... F21K 9/232; H01L 25/0753; H01L 33/483
See application file for complete search history.

(56) References Cited

U.S. PATENT DOCUMENTS

| | | | | |
|---|---|---|---|---|
| 9,291,311 | B2 * | 3/2016 | Chen | F21V 29/87 |
| 10,215,342 | B2 * | 2/2019 | Yang | F21K 9/232 |
| 2012/0300430 | A1 * | 11/2012 | Kawashima | F21K 9/232 362/84 |
| 2015/0009689 | A1 * | 1/2015 | Chen | F21K 9/232 362/382 |
| 2015/0252954 | A1 * | 9/2015 | Hu | F21K 9/23 362/382 |

* cited by examiner

*Primary Examiner* — Sharon E Payne
(74) *Attorney, Agent, or Firm* — Hemisphere Law, PLLC; Zhigang Ma

(57) ABSTRACT

The present disclosure relates to a LED filament and a LED bulb with the LED filament. The LED filament includes a carrier, LED chips disposed on the carrier, the carrier includes a first lateral section and a second lateral section opposite to the first lateral section, the LED chips are formed on the first lateral section, hardness of the first lateral section is less than that of the second lateral section. The disclosure further provides a LED bulb with the LED filament above. The LED filament above has benefits of improving structural strength and decreasing costs.

14 Claims, 4 Drawing Sheets

| Shore hardness type A | Shore hardness type D | Rockwell hardness |
|---|---|---|
| | | 150- |
| | | 140- |
| | | 130- |
| | | 120- |
| | | 110- |
| | 80- | 100- |
| | 70- | 90- |
| | 60- | 70- |
| 95- | 50- | 50- |
| 90- | 40- | |
| 80- | 30- | |
| 70- | | |
| 60- | | |
| 50- | | |
| 40- | | |
| 30- | | |
| 20- | | |

FIG. 8

LED FILAMENT AND LED BULB WITH LED FILAMENT

CROSS-REFERENCE TO RELATED APPLICATIONS

This application is a continuation of U.S. patent application Ser. No. 15/191,660, filed on Jun. 24, 2016, which claims the priority of Chinese Patent Application No. 201510423074.0, filed on Jul. 17, 2015, the disclosures of which are incorporated herein by reference in their entirety.

FIELD OF THE DISCLOSURE

The present disclosure relates to a LED illumination technical field, and more particularly to a LED filament and a LED bulb with the LED filament.

BACKGROUND OF THE DISCLOSURE

A light emitting diode (LED) is a solid-state semiconductor device that can transform electrical energy into visible light. A LED is an ideal light source that can take the place of a conventional light source since it contains benefits such as less energy consumption, longer service life and little environmental contamination, applied in various realms.

A conventional LED bulb can include a LED filament a stem, a transparent lampshade such as a spherical lampshade, and a lamp holder such as a thread lamp holder; the transparent lampshade, the stem and the lamp holder are connected firmly, the stem is disposed in the transparent lampshade and equipped with electrodes that can be connected to the LED filament in order to supply power to the LED filament.

A LED filament includes a copper frame and multiple LED chips disposed on the copper frame. The multiple LED chips can be series connected, parallel connected or series-parallel connected. However, during process of manufacturing a conventional LED bulb, a LED filament mounted on a column can be commonly manual, and an external force is needed in aligning welding, which can easily fail a component caused by the copper frame bend. Moreover, high costs cannot be avoided if power of a single conventional LED filament is increased.

SUMMARY OF THE DISCLOSURE

Therefore, aiming at disadvantages in a conventional technique, the disclosure provides a LED filament and a LED bulb with the LED filament.

Specifically, an embodiment of the disclosure provides a LED filament, including: a carrier, LED chips disposed on the carrier, the carrier includes a first lateral section and a second lateral section opposite to the first lateral section, the LED chips are formed on the first lateral section, hardness of the first lateral section is less than that of the second lateral section.

In an embodiment of the disclosure, the carrier includes a substrate, a first adhesive and a second adhesive, the substrate contains a first surface and a second surface opposite to the first surface, the LED chips are disposed on the first surface of the substrate, the first lateral section is formed by the first adhesive covering the first surface and the LED chips, the second lateral section is formed by the second adhesive covering the second surface.

In an embodiment of the disclosure, Shore hardness type A of the first adhesive is less than or equal to 55, Shore hardness type A of the second adhesive is more than or equal to 70, and a difference of the Shore hardness type A of the first adhesive and the Shore hardness type A of the second adhesive is more than or equal to 15.

In an embodiment of the disclosure, a material of the first adhesive is transparent resin, such as epoxy resin, silica gel, methyl silicone resin, phenyl silicone resin, methyl phenyl silicone resin or modified silicone resin.

In an embodiment of the disclosure, a material of the second adhesive is transparent resin, such as epoxy resin, silica gel, methyl silicone resin, phenyl silicone resin, methyl phenyl silicone resin or modified silicone resin.

In an embodiment of the disclosure, fluorescent powders are dispersed in the first adhesive and the second adhesive.

In an embodiment of the disclosure, the substrate is formed by a metal material, transparent ceramic, sapphire or glass.

In an embodiment of the disclosure, through-holes are defined on the substrate.

In an embodiment of the disclosure, the substrate includes a substrate, a first adhesive and a second adhesive, the substrate includes a first bracket and a second bracket connected with the first bracket, the first bracket contains an upper surface away from the second bracket, the second bracket contains a bottom surface away from the first bracket, the LED chips are disposed on the upper surface of the first bracket, the first adhesive covers the upper surface of the first bracket and the LED chips, the first adhesive and the first bracket form the first lateral section, the second adhesive covers the bottom surface of the second bracket, the second adhesive and the second bracket form the second lateral section.

In an embodiment of the disclosure, a thermal conductivity of the first bracket is higher than that of the second bracket.

In an embodiment of the disclosure, brittleness of the first bracket is more than that of the second bracket.

In an embodiment of the disclosure, a thickness of the first bracket is less than that of the second bracket.

In an embodiment of the disclosure, the first bracket and the second bracket are formed by metal materials.

In an embodiment of the disclosure, hardness of a metal material of the first bracket is less than that of the second bracket.

In an embodiment of the disclosure, the first bracket is formed by copper, the second bracket is formed by iron.

In an embodiment of the disclosure, the first bracket and the second bracket are connected by pasting with an adhesive.

In an embodiment of the disclosure, the first bracket and the second bracket are connected by electroplating.

In an embodiment of the disclosure, through-holes penetrating the first bracket and the second bracket are defined on the substrate.

In an embodiment of the disclosure, the first bracket is formed by transparent ceramic or sapphire, the second bracket is formed by glass.

In an embodiment of the disclosure, the first bracket and the second bracket are connected by pasting with an adhesive.

In an embodiment of the disclosure, the first bracket and the second bracket are connected by pasting with an adhesive, sintering, sputtering or electroplating.

The disclosure further provides a LED bulb, including: a lamp holder, a transparent lampshade, a stem and a LED filament, the transparent lampshade and the stem are connected with the lamp holder firmly, the LED filament can be any one of the LED filaments in embodiments above.

In conclusion, according to a LED filament and a LED bulb with the LED filament of the embodiments above, as the hardness of the first lateral section is less than that of the second lateral section, the LED filament above can be designed according to various requirements of structural strength, which can reduce costs without sacrificing structural strength.

In order to clearly illustrate the disclosure, the following figures will be described in detail, the drawings are merely for explanation instead of limitation. Furthermore, the figures are not sketched in scale, the purpose of the drawings is to illustrate structures and processes of corresponding description literally.

BRIEF DESCRIPTION OF THE DRAWINGS

Embodiments of the present disclosure are described in detail with reference to the accompanying drawings as follows.

FIG. 8 is a hardness chart in various types.

DETAILED DESCRIPTION OF PREFERRED EMBODIMENTS

Embodiments of the present disclosure are described in detail with reference to the accompanying drawings as follows to better understand the purpose, property and merits of the disclosure.

An First Embodiment

Figure 1:
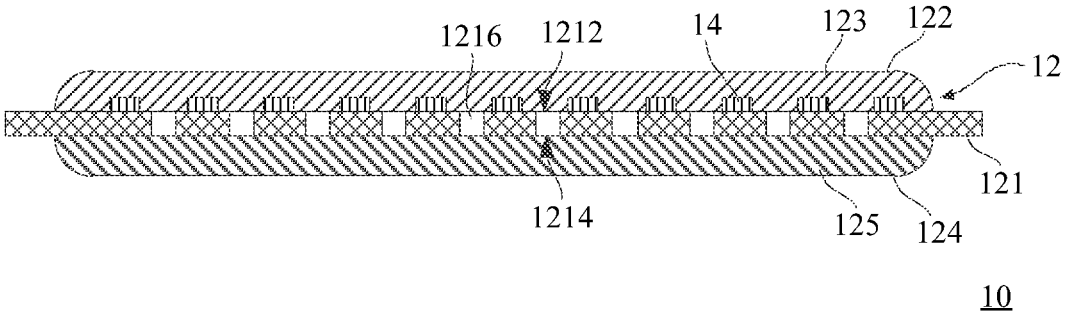
FIG. 1 is across-section diagram of a LED filament according to a first embodiment of the disclosure.

Referring to FIG. 1, a LED filament 10 provided by the first embodiment of the disclosure includes: a carrier 12, multiple LED chips 14 disposed on the carrier 12. The carrier 12 includes a first lateral section 122 and a second lateral section 124 opposite to the first lateral section 122. The LED chips 14 are formed on the first lateral section 122. Hardness of the first lateral section 122 is less than that of the second lateral section 124.

As the hardness of the first lateral section 122 is less than that of the second lateral section 124, the LED filament 10 above can be designed according to various requirements of structural strength, which can reduce costs without sacrificing structural strength of the LED filament 10.

In the embodiment, the carrier 12 includes a substrate 121, a first adhesive 123 and a second adhesive 125. The substrate 121 contains a first surface 1212 and a second surface 1214 opposite to the first surface 1212. The LED chips 14 are disposed on the first surface 1212 of the substrate 121. The first adhesive 123 covers the first surface 1212 and the LED chips 14, the second adhesive 125 covers the second surface 1214. The first adhesive 123 forms the first lateral section 122, the second adhesive 125 forms the second lateral section 124; in other words, the first lateral section 122 is formed by the first adhesive 123, the second lateral section is formed by the second adhesive 125.

Specifically, in the embodiment, hardness of the first adhesive 123 and that of the second adhesive 125 are measured by a Shore durometer type A, which means measured hardness is Shore hardness type A. Shore hardness type A of the first adhesive 123 can be less than or equal to 55, Shore hardness type A of the second adhesive 125 can be more than or equal to 70. Preferably, a difference of the Shore hardness type A of the first adhesive and the Shore hardness type A of the second adhesive can be more than or equal to 15. In other embodiments of the disclosure, based on the premise that hardness of the first adhesive 123 is less than that of the second adhesive 125, hardness of the first adhesive 123 and that of the second adhesive 125 can be measured in another type of hardness, such as shown in FIG. 8, hardness of the second adhesive 125 is measured in Shore hardness type D, the Shore hardness D is more than or equal to 20. A material of the first adhesive 123 can be transparent resin, such as epoxy resin, silica gel, methyl silicone resin, phenyl silicone resin, methyl phenyl silicone resin or modified silicone resin. A material of the second adhesive 125 can be transparent resin, such as epoxy resin, silica gel, methyl silicone resin, phenyl silicone resin, methyl phenyl silicone resin or modified silicone resin. In the embodiment, epoxy resin, silica gel, methyl silicone resin, phenyl silicone resin, methyl phenyl silicone resin or modified silicone resin are employed as base materials of the first adhesive 123 and the second adhesive 125, a difference in hardness of the first adhesive 123 and the second adhesive 125 can be achieved by adjusting ratio of the base material of the first adhesive 123 or that of the second adhesive 125 and fillers and additives. Similarly, time and temperature of heating to solidification of the first adhesive 123 or that of the second adhesive 125 can also be applied to change the hardness without harming other physical features. Otherwise, fluorescent powders can be dispersed in the first adhesive 123 and/or the second adhesive 125, by which color of light from the LED chips 14 can be adjusted as well.

The substrate 121 can be formed by a metal material, and through-holes 1216 are defined on the substrate 121. An effect of the through-holes is to guide lights, which leads to lights from the LED chips 14 can be radiated from the second lateral section 124.

The LED chips 14 can be multiple, the LED chips 14 can be series connected, parallel connected or series-parallel connected, each of the LED chips 14 can be connected electrically by metal wires printed on the carrier 12.

The carrier 12 of the LED filament 10 above includes the first lateral section 122 and the second lateral section 124 opposite to the first lateral section 122, the hardness of the first lateral section 122 is less than that of the second lateral section 124, and the first lateral section 122 is formed by the first adhesive 123, the second lateral section 124 is formed by the second adhesive 125; therefore, the LED filament 10 can obtain high structural strength with low costs. Moreover, as the first lateral section 122 and the second lateral section 124 are formed by the first adhesive 123 and second adhesive 125 separately, the first adhesive 123 can select an adhesive with better heat resistance and heat dissipation, and the second adhesive 125 can select an adhesive with regular heat resistance and heat dissipation; consequently, the LED filament 10 can be guaranteed to dissipate heat rapidly and evenly without increasing costs, which can improve operational power of the LED filament 10.

A Second Embodiment

Figure 2:
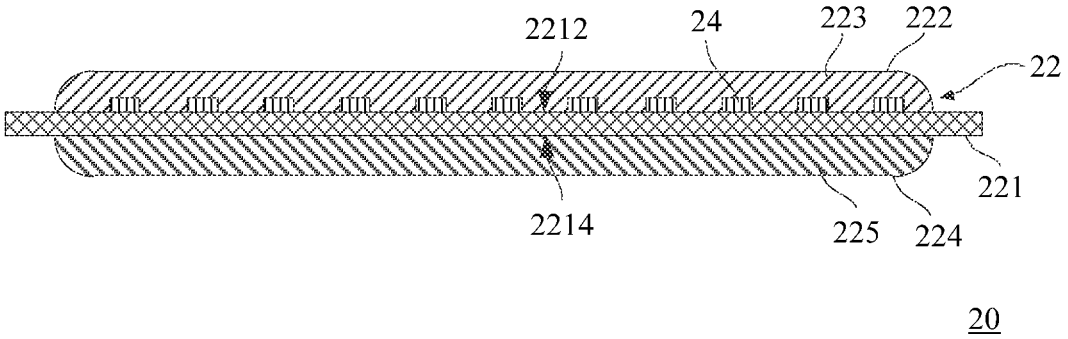
FIG. 2 is a cross-section diagram of a LED filament according to a second embodiment of the disclosure.

FIG. 2 is a LED filament 20 provided by the second embodiment of the disclosure. The LED filament 20 is similar with the LED filament 10, including a carrier 22, multiple LED chips 24 disposed on the carrier 22. The carrier 22 includes a substrate 221, a first adhesive 223 and a second adhesive 225. The substrate 221 contains a first surface 2212 and a second surface 2214 opposite to the first surface 2212. The LED chips 24 are disposed on the first surface 2212 of the substrate 221. The first adhesive 223 covers the first surface 2212 and the LED chips 24, the second adhesive 225 covers the second surface 2214. The first adhesive 223 forms a first lateral section 222, the second adhesive 225 forms the second lateral section 224. A difference of the LED filament 20 and the LED filament 10 is: the substrate 221 of the LED filament 20 is formed by a transparent material, such as transparent ceramic, sapphire or glass. And since the substrate 221 is formed by a transparent material, a through-hole is unnecessary to be defined on the substrate 221.

A Third Embodiment

Figure 3:
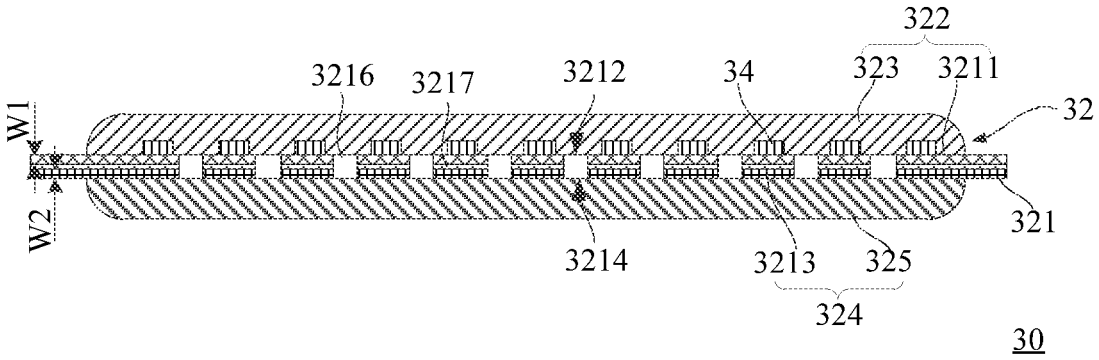
FIG. 3 is a cross-section diagram of a LED filament according to a third embodiment of the disclosure.

FIG. 3 is a LED filament 30 provided by the third embodiment of the disclosure. The LED filament 30 is similar with the LED filament 10, including a carrier 32, multiple LED chips 34 disposed on the carrier 32. The carrier 32 includes a first lateral section 322 and a second lateral section 324 opposite to the first lateral section 322. The LED chips 34 are disposed on the first lateral section 322. Hardness of the first lateral section 322 is less than that of the second lateral section 324.

In the embodiment, the carrier 32 includes a substrate 321, a first adhesive 323 and a second adhesive 325. The substrate 321 contains a first bracket 3211 and a second bracket 3213 connected with the first bracket 3211. The first bracket 3211 contains an upper surface 3212 away from the second bracket 3213, the second bracket 3213 contains a bottom surface 3214 away from the first bracket 3211. The LED chips 34 are disposed on the upper surface 3212 of the first bracket 3211, the first adhesive 323 covers the upper surface 3212 of the first bracket 3211 and the LED chips 34, the second adhesive 325 covers the bottom surface 3214 of the second bracket 3213. The first adhesive 323 and the first bracket 3211 form the first lateral section 322, the second adhesive 325 and the second bracket 3213 form the second lateral section 324.

Specifically, a thermal conductivity of the first bracket 3211 can be higher than that of the second bracket 3213. Brittleness of the first bracket 3211 can be more than that of the second bracket 3213. A thickness W1 of the first bracket 3211 can be less than that W2 of the second bracket 3213.

In the embodiment, the first bracket 3211 and the second bracket 3213 are formed by metal materials, with a requirement of hardness of a metal material of the first bracket 3211 is less than that of the second bracket 3213. For instance, when the first bracket 3211 is formed by copper and the second bracket 3213 is formed by iron, copper can dissipate heat from the LED chips 34 easier because the thermal conductivity is higher, preventing temperature around the LED chips 34 from being excessive; yet iron of the second bracket 3213 can improve the entire structural strength of the LED filament 30 as the property of high strength, and iron materials have high thermal capacity, which can store more heat; hence the LED filament 30 can have higher optional power.

In the embodiment, the first bracket 3211 and the second bracket 3213 are formed by opaque metal materials, for which through-holes 3216 applied to guide lights can be defined on the substrate 321.

Furthermore, in the embodiment, the first bracket 3211 and the second bracket 3213 are connected by pasting with an adhesive 3217. The adhesive 3217 is preferably a thermal conductive adhesive.

A Fourth Embodiment

Figure 4:
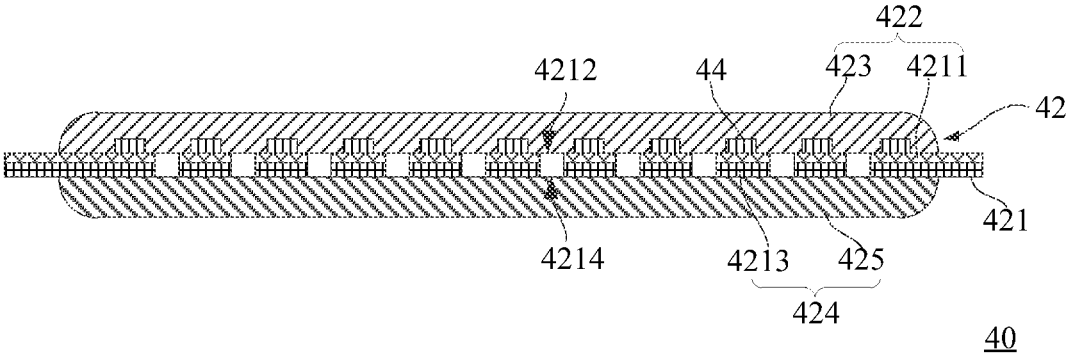
FIG. 4 is a cross-section diagram of a LED filament according to a fourth embodiment of the disclosure.

FIG. 4 is a LED filament 40 provided by the fourth embodiment of the disclosure. The LED filament 40 is similar with the LED filament 30, including a carrier 42, multiple LED chips 44 disposed on the carrier 42. The carrier 42 includes a substrate 421, a first adhesive 423 and a second adhesive 425; the substrate 421 contains a first bracket 4211 and a second bracket 4213 connected with the first bracket 4211; the first bracket 4211 contains an upper surface 4212 away from the second bracket 4213, the second bracket 4213 contains a bottom surface 4214 away from the first bracket 4211; LED chips 44 are disposed on the upper surface 4212 of the first bracket 4211, the first adhesive 423 covers the upper surface 4212 of the first bracket 4211 and the LED chips 44, the second, adhesive 425 covers the bottom surface 4214 of the second bracket 4213; the first adhesive 423 and the first bracket 4211 form a first lateral section 422, the second adhesive 425 and the second bracket 4213 form a second lateral section 424. A difference of the LED filament 40 and the LED filament 30 is: the first bracket 4211 of the LED filament 40 is connected to the second bracket 4213 by electroplating. Similarly, in other embodiments, the second bracket 4213 of the LED filament 40 can be connected to the first bracket 4211 by electroplating.

A Fifth Embodiment

Figure 5:
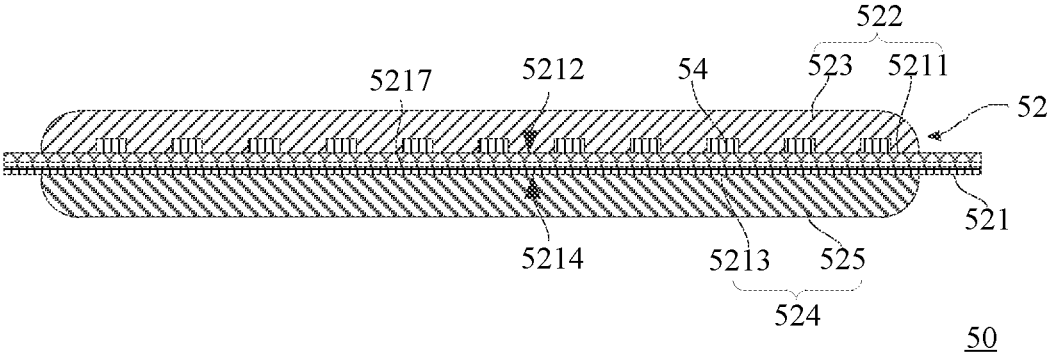
FIG. 5 is a cross-section diagram of a LED filament according to a fifth embodiment of the disclosure.

FIG. 5 is a LED filament 50 provided by the fifth embodiment of the disclosure. The LED filament 50 is similar with the LED filament 30, including a carrier 52, multiple LED chips 54 disposed on the carrier 52. The carrier 52 includes a substrate 521, a first adhesive 523 and a second adhesive 525; the substrate 521 contains a first bracket 5211 and a second bracket 5213 connected with the first bracket 5211; the first bracket 5211 contains an upper surface 5212 away from the second bracket 5213, the second bracket 5213 contains a bottom surface 5214 away from the first bracket 5211; LED chips 54 are disposed on the upper surface 5212 of the first bracket 5211, the first adhesive 523 covers the upper surface 5212 of the first bracket 5211 and the LED chips 54, the second adhesive 525 covers the bottom surface 5214 of the second bracket 5213; the first adhesive 523 and the first bracket 5211 form a first lateral section 522, the second adhesive 525 and the second bracket 5213 form a second lateral section 524. The first bracket 5211 and the second bracket 5213 are connected by pasting with an adhesive 5217. A difference of the LED filament 50 and the LED filament 30 is: the substrate 521 of the LED filament 50 is formed by a transparent material, such as transparent ceramic, sapphire or glass. Specifically, the first bracket 5211 can be formed by transparent ceramic or sapphire, the second bracket 5213 can be formed by glass. Since the first bracket 5211 and the second bracket 5213 of the substrate 521 are formed by a transparent material separately, a through-hole applied to guide lights is unnecessary to be defined on the substrate 521.

A Sixth Embodiment

Figure 6:
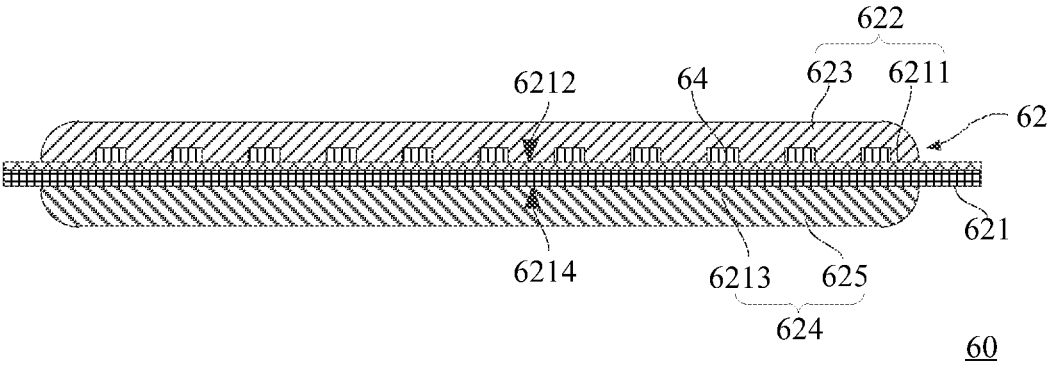
FIG. 6 is a cross-section diagram of a LED filament according to a sixth embodiment of the disclosure.

FIG. 6 is a LED filament 60 provided by the sixth embodiment of the disclosure. The LED filament 60 is similar with the LED filament 50, including a carrier 62, multiple LED chips 64 disposed on the carrier 62. The carrier 62 includes a substrate 621, a first adhesive 623 and a second adhesive 625; the substrate 621 contains a first bracket 6211 and a second bracket 6213 connected with the first bracket 6211; the first bracket 6211 contains an upper surface 6212 away from the second bracket 6213, the second bracket 6213 contains a bottom surface 6214 away from the first bracket 6211; LED chips 64 are disposed on the upper surface 6212 of the first bracket 6211, the first adhesive 623 covers the upper surface 6212 of the first bracket 6211 and the LED chips 64, the second adhesive 625 covers the bottom surface 6214 of the second bracket 6213; the first adhesive 623 and the first bracket 6211 form a first lateral section 622, the second adhesive 625 and the second bracket 6213 form a second lateral section 624. A difference of the LED filament 60 and the LED filament 50 is: the first bracket 6211 of the LED filament 60 is connected to the second bracket 6213 by sintering, sputtering or electroplating.

A Seventh Embodiment

Figure 7:
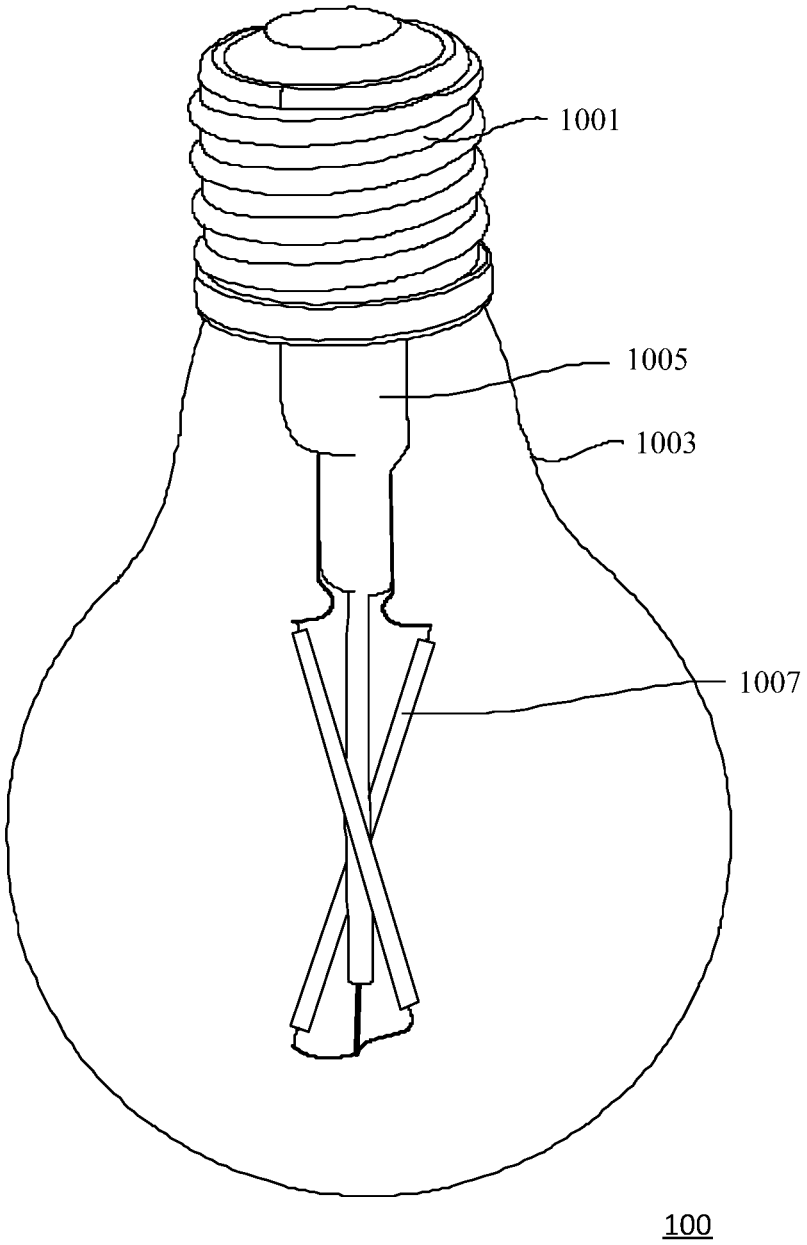
FIG. 7 is a cross-section diagram of a LED filament according to a seventh embodiment of the disclosure.

FIG. 7 is a LED bulb 100 provided by the seventh embodiment of the disclosure, including: a lamp holder 1001, a transparent lampshade 1003, a stem 1005 and at least one LED filament 1007. The lamp holder 1001 is a thread lamp holder; the transparent lampshade 1003 and the stem 1005 are both connected to the lamp holder 1001 firmly; wires can be disposed on the stem 1005 as electrodes of a power source, the electrodes are connected with an outlet by the lamp holder 1001 to supply power for LED chips on the LED filament 1007. Furthermore, the amount of LED filament 1007 can be one or more, depending on actual requirements. In the embodiment, the LED filament can be any one of the LED filaments in embodiments 1-6 above without repeat.

Overall, according to the LED filaments and the LED bulb with the LED filament of the embodiments of the disclosure, as hardness of the first lateral section is less than that of the second lateral section, the LED filaments above can be designed based on various requirements of structural strength, which can reduce costs without sacrificing structural strength.

Till now, several embodiments are employed in the disclosure to illustrate principles and executions of the LED filaments and LED bulb of the disclosure, embodiments above are merely for explaining methods and spirits of the disclosure; meanwhile, it is understandable in practical to a person skilled in the art that all or portion of the processes in the method according to the aforesaid embodiment can be accomplished with modifications, equivalent replacements or improvements, in conclusion, the embodiments described above should not be regarded as a limitation, the scope should be covered by the claims.

What is claimed is:

1. A LED filament, comprising: a carrier, LED chips disposed on the carrier, wherein the carrier comprises a first lateral section, and a second lateral section opposite to the first lateral section in a thicknesswise direction of the carrier, the LED chips are formed on the first lateral section and covered by the first lateral section and thereby lights emitted from the LED chips are guided outside of the carrier through the first lateral section and the second lateral section, and hardness of the first lateral section is less than that of the second lateral section;

wherein the carrier comprises a substrate, a first adhesive and a second adhesive, the substrate comprises a first bracket and a second bracket connected with the first bracket, the first bracket has an upper surface away from the second bracket, the second bracket has a bottom surface away from the first bracket, the LED chips are disposed on the upper surface of the first bracket, the first adhesive covers the upper surface of the first bracket and the LED chips, the first adhesive and the first bracket form the first lateral section, the second adhesive covers the bottom surface of the second bracket, the second adhesive and the second bracket form the second lateral section;

wherein a thermal conductivity of the first bracket is higher than that of the second bracket, brittleness of the first bracket is more than that of the second bracket, and a thickness of the first bracket is less than that of the second bracket.

2. The LED filament according to claim 1, wherein Shore hardness type A of the first adhesive is less than or equal to 55, Shore hardness type A of the second adhesive is more than or equal to 70, and a difference of the Shore hardness type A of the first adhesive and the Shore hardness type A of the second adhesive is more than or equal to 15.

3. The LED filament according to claim 1, wherein a material of the first adhesive and the second adhesive is epoxy resin, silica gel, methyl silicone resin, phenyl silicone resin, methyl phenyl silicone resin or modified silicone resin, fluorescent powders are dispersed in the first adhesive and the second adhesive.

4. The LED filament according to claim 1, wherein the substrate is formed by a metal material, transparent ceramic, sapphire or glass, through-holes are defined on the substrate.

5. The LED filament according to claim 1, wherein the first bracket and the second bracket are formed by metal materials, and hardness of the metal material of the first bracket is less than that of the second bracket.

6. The LED filament according to claim 1, wherein the first bracket is formed by transparent ceramic or sapphire, the second bracket is formed by glass.

7. The LED filament according to claim 1, wherein the first bracket and the second bracket are connected by pasting with an adhesive, sintering, sputtering, evaporate plating or electroplating.

8. A LED bulb, comprising: a lamp holder, a transparent lampshade, a stein and a LED filament, the transparent lampshade and the stein connected with the lamp holder firmly, the LED filament comprising: a carrier, LED chips disposed on the carrier, wherein the carrier comprises a first lateral section, and a second lateral section opposite to the first lateral section in a thicknesswise direction of the carrier, the LED chips are formed on the first lateral section and covered by the first lateral section and thereby lights emitted from the LED chips are guided outside of the carrier through the first lateral section and the second lateral section, and hardness of the first lateral section is less than that of the second lateral section;

wherein the carrier comprises a substrate, a first adhesive and a second adhesive, the substrate comprises a first bracket and a second bracket connected with the first bracket, the first bracket has an upper surface away from the second bracket, the second bracket has a bottom surface away from the first bracket, the LED chips are disposed on the upper surface of the first bracket, the first adhesive covers the upper surface of the first bracket and the LED chips, the first adhesive and the first bracket form the first lateral section, the second adhesive covers the bottom surface of the second bracket, the second adhesive and the second bracket form the second lateral section;

wherein a thermal conductivity of the first bracket is higher than that of the second bracket, brittleness of the first bracket is more than that of the second bracket, and a thickness of the first bracket is less than that of the second bracket.

9. The LED bulb according to claim 8, wherein Shore hardness type A of the first adhesive is less than or equal to 55, Shore hardness type A of the second adhesive is more than or equal to 70, and a difference of the Shore hardness type A of the first adhesive and the Shore hardness type A of the second adhesive is more than or equal to 15.

10. The LED bulb according to claim 8, wherein a material of the first adhesive and the second adhesive is epoxy resin, silica gel, methyl silicone resin, phenyl silicone resin, methyl phenyl silicone resin or modified silicone resin, fluorescent powders are dispersed in the first adhesive and the second adhesive.

11. The LED bulb according to claim 8, wherein the substrate is formed by metal materials, transparent ceramic, sapphire or glass, through-holes are defined on the substrate.

12. The LED bulb according to claim 8, wherein the first bracket and the second bracket are formed by metal materials, and hardness of the metal material of the first bracket is less than that of the second bracket.

13. The LED bulb according to claim 8, wherein the first bracket is formed by transparent ceramic or sapphire, the second bracket is formed by glass.

14. The LED bulb according to claim 8, wherein the first bracket and the second bracket are connected by pasting with an adhesive, sintering, sputtering, evaporate plating or electroplating.

* * * * *